US011121441B1

(12) United States Patent
Rmili et al.

(10) Patent No.: US 11,121,441 B1
(45) Date of Patent: Sep. 14, 2021

(54) SURFACE INTEGRATED WAVEGUIDE INCLUDING RADIATING ELEMENTS DISPOSED BETWEEN CURVED SECTIONS AND PHASE SHIFT ELEMENTS DEFINED BY SPACED APART VIAS

(71) Applicant: King Abdulaziz University, Jeddah (SA)

(72) Inventors: Hatem Malik Rmili, Jeddah (SA); Abdulah Jeza Aljohani, Jeddah (SA); Abdelkhalek Nasri, Jeddah (SA); Raj Mittra, Jeddah (SA)

(73) Assignee: King Abdulaziz University, Jeddah (SA)

( * ) Notice: Subject to any disclaimer, the term of this patent is extended or adjusted under 35 U.S.C. 154(b) by 0 days.

(21) Appl. No.: 17/160,669

(22) Filed: Jan. 28, 2021

(51) Int. Cl.

| | |
|---|---|
| ***H01P 1/18*** | (2006.01) |
| ***H01P 3/12*** | (2006.01) |
| ***H01P 1/185*** | (2006.01) |
| ***H01P 9/00*** | (2006.01) |
| ***H01Q 3/36*** | (2006.01) |

(52) U.S. Cl.
CPC ..... *H01P 1/182* (2013.01); *H01P 1/185* (2013.01); *H01P 3/121* (2013.01); *H01P 9/006* (2013.01); *H01Q 3/36* (2013.01)

(58) Field of Classification Search
CPC .. H01P 1/182; H01P 1/185; H01P 1/18; H01P 9/006; H01Q 3/30; H01Q 3/32; H01Q 3/36; H01Q 13/22
USPC ..... 333/157; 343/771
See application file for complete search history.

(56) References Cited

U.S. PATENT DOCUMENTS

| | | | | |
|---|---|---|---|---|
| 3,290,624 | A * | 12/1966 | Hines | H01P 1/185 333/164 |
| 7,808,439 | B2 * | 10/2010 | Yang et al. | H01Q 13/22 343/771 |
| 7,900,340 | B2 * | 3/2011 | Artis et al. | H01Q 3/22 29/600 |
| 2018/0212324 | A1 * | 7/2018 | Tatomir | H01Q 13/0233 |

* cited by examiner

*Primary Examiner* — Benny T Lee
(74) *Attorney, Agent, or Firm* — W & C IP

(57) ABSTRACT

A substrate integrated waveguide (SIW) for phase shifter for millimeter wave applications has a waveguide with a plurality of curved sections and which passes through the substrate from a wave entry port to a wave exit port. The plurality of curved sections forms a serpentine path of curves in a first direction followed by curves in a second direction which are opposite the first direction. Phase shifting elements are positioned in the waveguide in each of the curved sections. The phase shifting elements may take the form of PIN diodes or a pattern of liquid metal filled vias in the waveguide.

4 Claims, 5 Drawing Sheets

SURFACE INTEGRATED WAVEGUIDE INCLUDING RADIATING ELEMENTS DISPOSED BETWEEN CURVED SECTIONS AND PHASE SHIFT ELEMENTS DEFINED BY SPACED APART VIAS

BACKGROUND

Phase shifters are components that play a very important role in microwave applications such as phase-array antenna systems, phase-modulation communications systems and others. The phase shifters are used to introduce phase tapers in the radiating elements of an array to scan the beam of the radiating elements in the desired direction. Phase shifter designs have a long history. The first differential phase shifter is the Schiffman phase shifter, which uses an edge-coupled strip line section (see O. Kramer, T. Djerafi, and K. Wu, "Dual-layered substrate-integrated waveguide six-port with wideband double-stub phase shifter," *IET Microw. Anten. Propag.*, vol. 6, no. 15, pp. 1704-1709, 2012). Later many researchers devoted their attention to enhancing the performance of phase shifters. In A. Tribak, A. Mediaville, J. Zbitou and J. L. Cano, "Novel ridged waveguide differential phase shifter for satellite application," *Inter. Jour. of Microw. and Opt. Techno.*, vol. 9, no. 6, pp. 409-414, November 2014, a wideband two-layered SIW six-port was designed to operate over the V-band. It exhibits good performance, but over a very narrow bandwidth. M. X. Xiaoao, S. W. Cheung, and T. I. Yuk, "A C-band wideband 360° analog phase shifter design," *Microw. and Opt. Techn. Let.* vol 52, no 2, p. 355-359, February 2010 describes broadband differential phase shifters using bridged T-type bandpass networks. The proposed phase shifter network can improve the bandwidth of phase error while keeping good return loss. Another approach using a multi-layered phase shifters for 60 GHz WPAN applications and a mm-wave MEMS phase shifter based on a slow wave structure have been described in G. M. Rebeiz, G.-L. Tan, and J. S. Hayden, "RF MEMS phase shifters: design and applications," *IEEE Microw. Maga.*, vol 3, no 2, p. 72-81, June 2002, and P. Yaghmaee, O. H. Karabey, B. Bates, C. Fumeaux, and R. Jakoby, "Electrically Tuned Microwave Devices Using Liquid Crystal Technology," *Inter. Jour. of Anten. and Propag.*, vol. 2013, pp. 1-10, September 2013, respectively. Despite extensive research to improve the design and performance of the phase shifter, the search for low-cost phase shifters, which provide one- or two-dimensional scan capability to fixed-beam array antennas at millimeter waves that are finding widespread use at millimeter waves for fifth generation (5G) communication, continues unabated.

Phased array antennas are widely used for beam scanning applications in communication systems. It is well known that conventional phase shifters utilized in these applications are lossy, bulky and costly. Extensive research has been carried out in recent years for designing phased array antennas, especially in the context of satellite communication applications, and the design of civilian radar-based sensors. A number of different approaches have been proposed for scanning the beams of phased array antennas for these applications. Most of these approaches call for biasing configurations that are needed, either for activating certain switches, e.g., pin diodes or varactor diodes, or for modifying the electrical properties of materials, in order to realize the desired phase-shift when integrated with the antenna elements of the array. FIGS. 1A and 1B show some typical examples of such devices that are commonly used for this purpose. They introduce step-wise phase shifts in the fields radiated by the antenna elements to realize beam scanning by the array. An exemplary rectangular patch antenna (i.e., planar antenna) configuration providing two fixed-size patches with bias lines that are printed onto different stacked substrate layers, opportunely spaced with respect to each other with orienting layers and a spacer, having a thickness h (lc) (bottom panel) and liquid crystals (LC) is shown in FIG. 1A. The dielectric material configuration also includes a superstrate layer and a ground plane for the reflection of its image. In this case, micro-electrical-mechanical-systems (MEMS) switches are used as a reconfigurable feed network to achieve the pattern reconfigurability (FIG. 1B). Here, $P_x$, $P_y$ represents the actual lengths of the patch and $L_x$, $L_y$ represents the actual lengths of the LC, $h_s$ represents the thickness of the superstrate, $h_{lc}$ represents the thickness of the LC and ε represents the effective dielectric constant of the superstrate and/or LC.

As noted above, scanning arrays play a key role in 5G applications and satellite communication, and phase shifters are key components of these arrays. It is highly desired that the phase shifter be light weight, have low profile and that it provides a wide-angle scan capability. In Z. R. Omam, W. M. Abdel-Wahab, A. Raeesi, A. Palizaban, A. Pourziad, S. Nikmehr, S. Gigoyan, and S. Safavi-Naeini, "Ka-Band Passive Phased-Array Antenna With Substrate Integrated Waveguide Tunable Phase Shifter," *IEEE Transactions on Antennas and Propagation.*, vol. 68, no 8, pp. 6039-6048, August 2020, there is described a low-cost array antenna using a continuously tunable substrate integrated waveguide (SIW) phase shifter. In Y. Zhu, R. Lu, C. Yu, and_W. Hong, "Design and Implementation of a Wide band Antenna Subarray for Phased Array Applications,". *IEEE Transactions on Antennas and Propagation.*, vol. 68, no. 8, pp. 6059-6068, August 2020, there is proposed a multilayer structure to design a wideband antenna subarray for phased array applications. Additionally, K. Tekkouk, M. Ettorre, and R. Sauleau, "SIW Rotman Lens Antenna With Ridged Delay Lines and Reduced Footprint," *IEEE Transactions On Microwave Theory And Techniques*, vol. 66, no. 6, pp. 3136-3144, June 2018 proposed a method based on SIW Rotman Lens Antenna to achieve results in scanning on an angular sector of about ±48°. But these proposed designs are still bulky, difficult to fabricate and they need many excitation ports.

SUMMARY OF THE INVENTION

An aspect of the invention is to provide low-cost phase shifters that help mitigate the problems of lossiness, bulkiness, and costliness. The inventors propose a phase shifter design which totally bypasses ferrite-based conventional phase shifters that are both costly and highly lossy at millimeter waves. Instead, embodiments of the invention use a new technique based upon the fact that the propagation constant in the waveguide varies as a function of the width of the guide.

According to an embodiment of the invention, a phase shifter is inserted between two radiating elements in a substrate integrated waveguide (SIW) in order to realize the desired phase taper between the elements. This enables the array to generate multiple beams which scan the space to cover the desired angular range.

A particular goal of this invention is to provide a new design for a beam scanning array antenna, which has the advantages of low cost, low profile and ease of manufacturing.

DETAILED DESCRIPTION OF THE INVENTION

A lightweight, low profile array antenna with wide-angle scan capability is desired for the rising demands of 5G communication. To address the design challenge, the inventive phase shifter utilizes a curved substrate integrated waveguide. The proposed design utilizes physics which is totally different from the design that forms the basis of legacy phase shifting devices, e.g., ferrite phase shifters. The low-cost phase shifter may be integrated in 5G communication systems.

Figure 1A:
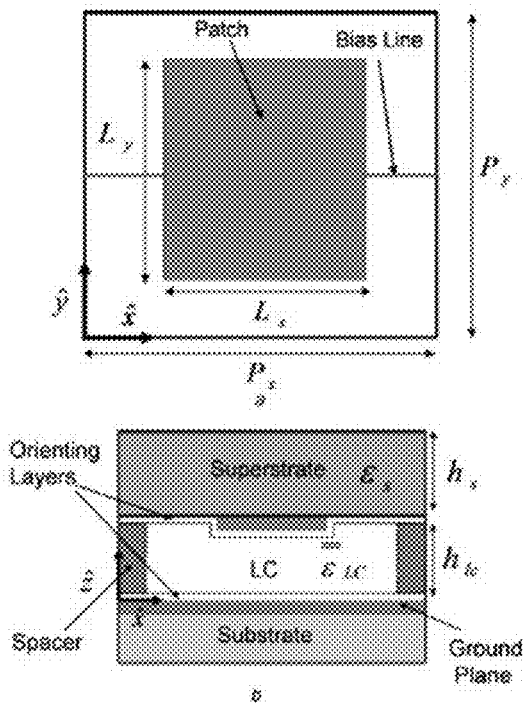
FIGURE 1A (PRIOR ART)
FIG. 1A are plan and side views of a prior art of a switch based phase shifting configuration.
Figure 1B:
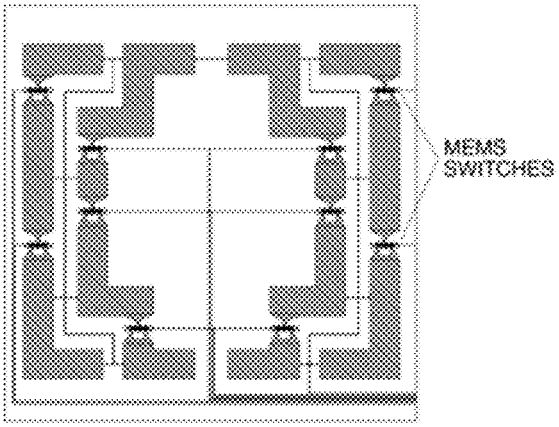
FIGURE 1B (PRIOR ART)
FIG. 1B is a plan view of a prior art of a liquid crystal based phase shifting configuration.
Figure 2:
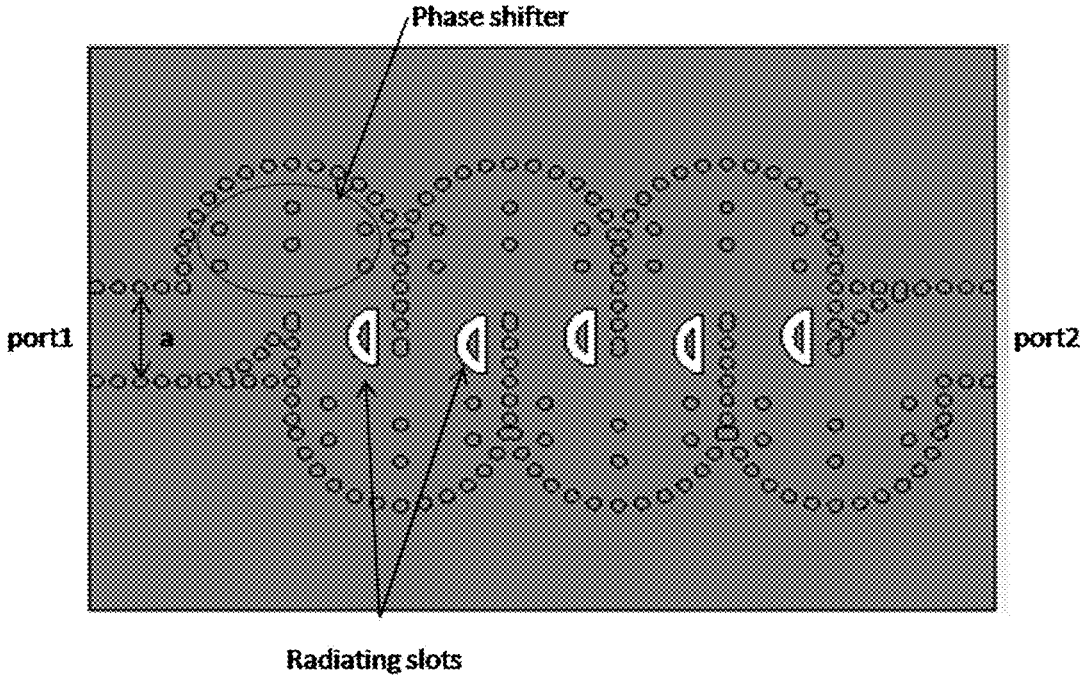
FIG. 2 shows the geometry of an exemplary SIW waveguide with phase shifter.

FIG. 2 shows an exemplary SIW phase shifter geometry according to the invention. In particular, there is shown a substrate having length, width and height dimensions. For exemplary purposes, the SIW guide is fabricated by using a Rogers Duroid 5880 substrate with a thickness of 3 mm, and a dielectric constant of 2.2. Other materials having different thicknesses and dielectric constants may also be employed. Typically a substrate is included in an SIW for mechanical reasons to provide support and the choice of the material is not critical as long as the material is low loss at the frequency of interest. The substrate has a wave entry port on a first end (i.e., port 1, shown in FIGS. 2 and 4) and a wave exit port on a second end (i.e., port 2, shown in FIGS. 2 and 4) of the substrate, wherein the first and second ends are opposite ends of the substrate. The waveguide includes a plurality of curved sections which form a serpentine path of curves in a first direction followed by curves in a second direction which is opposite the first direction. A plurality of radiating members (sometimes referred to as elements) extend into the waveguide between curves in the first direction and curves in the second direction. The radiating elements of the array, in some embodiments, are semi-circular radiating slots spaced approximately one half-wavelength apart in free space.

Figure 3:
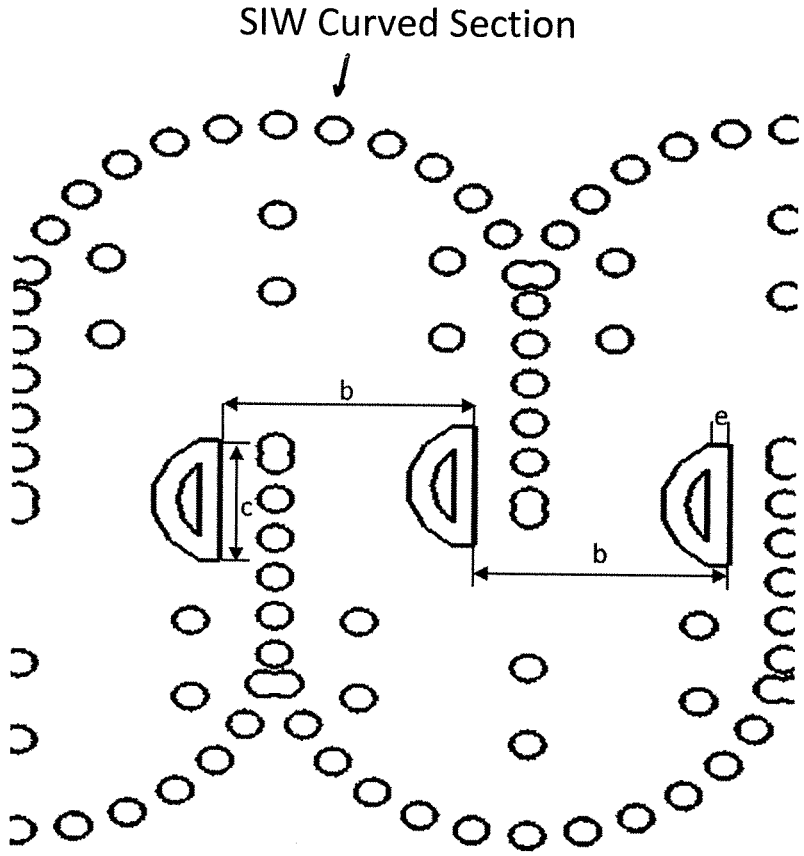
FIG. 3 is a close up view of the SIW waveguide of FIG. 2 and shows features of the proposed radiating elements of the array.

The effective width of the straight sections of the SIW waveguide is "a" (see FIG. 2). The distance between radiating elements is "b" (see FIG. 3). In some embodiments a=b. In the figures, "a" the width of the SIW and "b" the separation distance between radiating elements are both close to half wavelength, "c" and "e" are the length and width of the rectangular part of the slots, respectively. The relevant dimensions of the exemplary device shown in FIGS. 2 and 3 are as set forth in Table I.

TABLE I

THE DIMENSIONS OF THE SIW PHASE SHIFTER

| Length | Width | a | b | c | e |
|---|---|---|---|---|---|
| 50 mm | 24 mm | 6 mm | 6 mm | 3.66 mm | 0.5 mm |

"a" and "b" are close to half wavelength to make an acceptable side lobe level and c and e are optimized to keep the reflexion coefficient under −10 dB for all phase shifters. The propagation constant in the waveguide varies as a function of the width of the guide. If the value of the width of the guide is changed, the resonance frequency varies because the propagation constant varies.

In FIG. 2, each of the curved SIW sections between the slots contain phase shifters. In FIG. 2, the phase shifters are metalized vias of a diameter equal to 0.8 mm and they are spaced 0.4 mm apart. The via thickness is preferably the same for all vias. The spacing between vias that present the waveguide and curved waveguide is the same and is equal to 1.2 mm from center to center vias. But for the vias which are representing the phase shifters, the spacing depends on the desirable phase shifter. The phase shift is realized by switching the metalized vias inside the curved waveguide sections. The vias which are presenting the different phase shifters (see FIG. 5) may be configured and operated by a control mechanism to have mutually exclusive combinations of being filled with a conductor or being devoid of a conductor filling.

Figure 4:
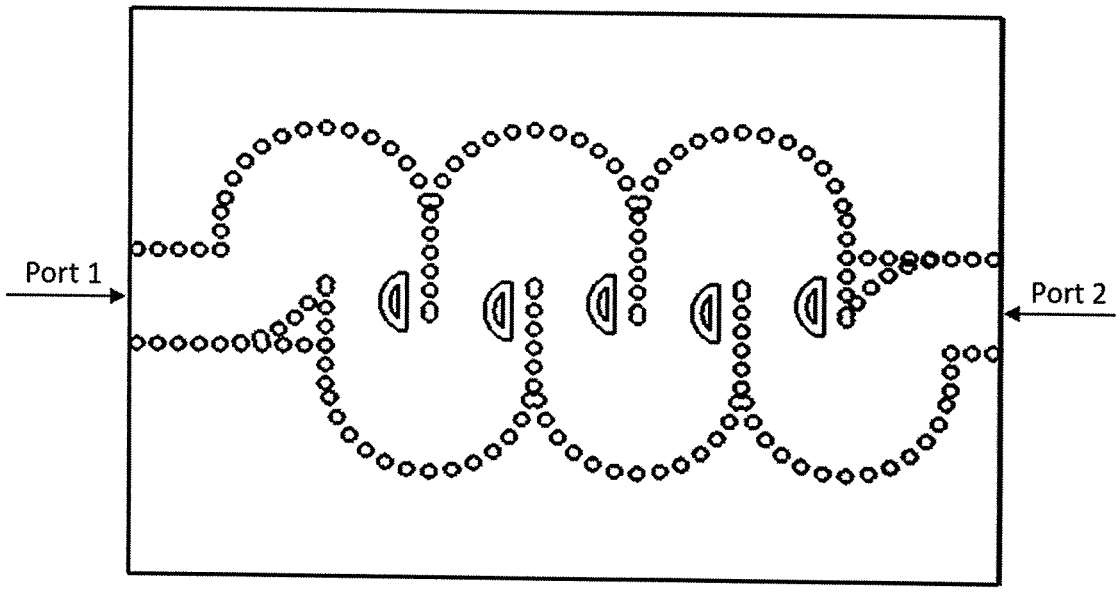
FIG. 4 is a view of the curved SIW of FIG. 2 without the phase shifter elements.
Figure 5:
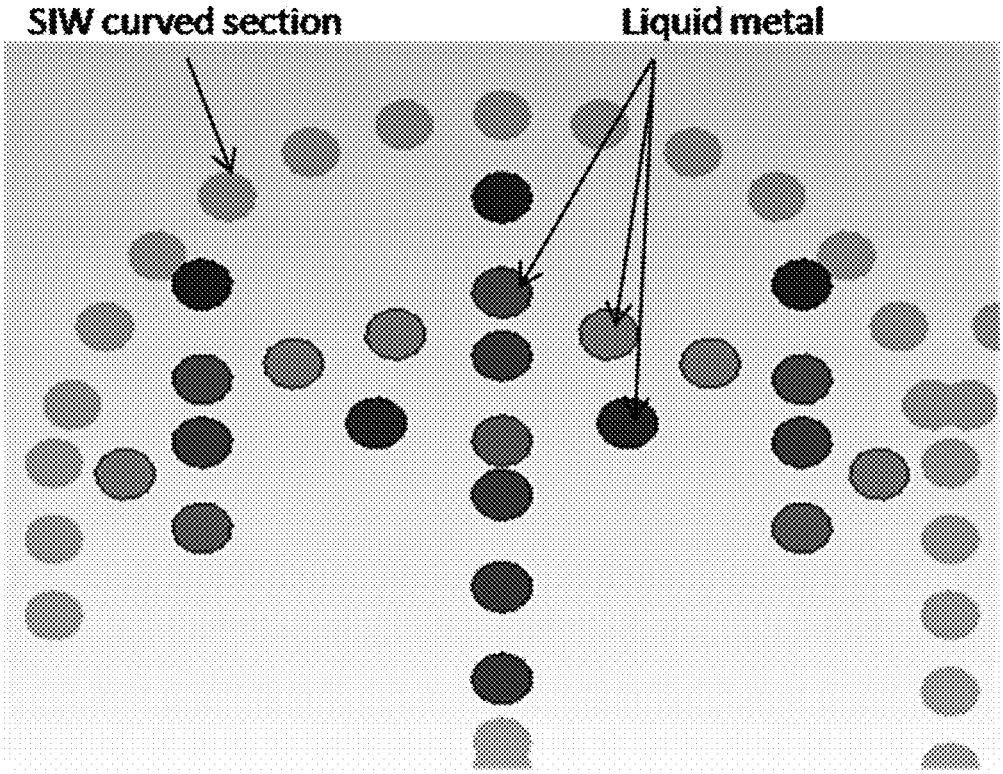
FIG. 5 is a view of one curved section of the SIW including spaced apart metallized vias, wherein the vias are designed to provide the different phase shifters.

In the fabrication process the curved SIW with slots, but without any phase shifters, is preferably produced first as shown in FIG. 4. Next, the phase shifter is inserted inside the curved sections to scan the array (i.e., scan the beam). FIGS. 4 and 5 show different exemplary alternatives for the phase shifter shown in FIG. 2. The alternative shown in FIG. 5 is based on the use of liquid metal deposited in at least some of the vias. The via configuration is varied to realize different phase shifts, which in turn determine the scan angle of the array. The liquid metal is used to fill the dielectric tubes which are positioned inside the curved waveguide sections. As noted above, the vias presenting the different phase shifters (see FIG. 5) may be configured and operated by a control mechanism to have mutually exclusive combinations of being filled with a liquid metal or being devoid of filling by a liquid metal.

Figure 6:
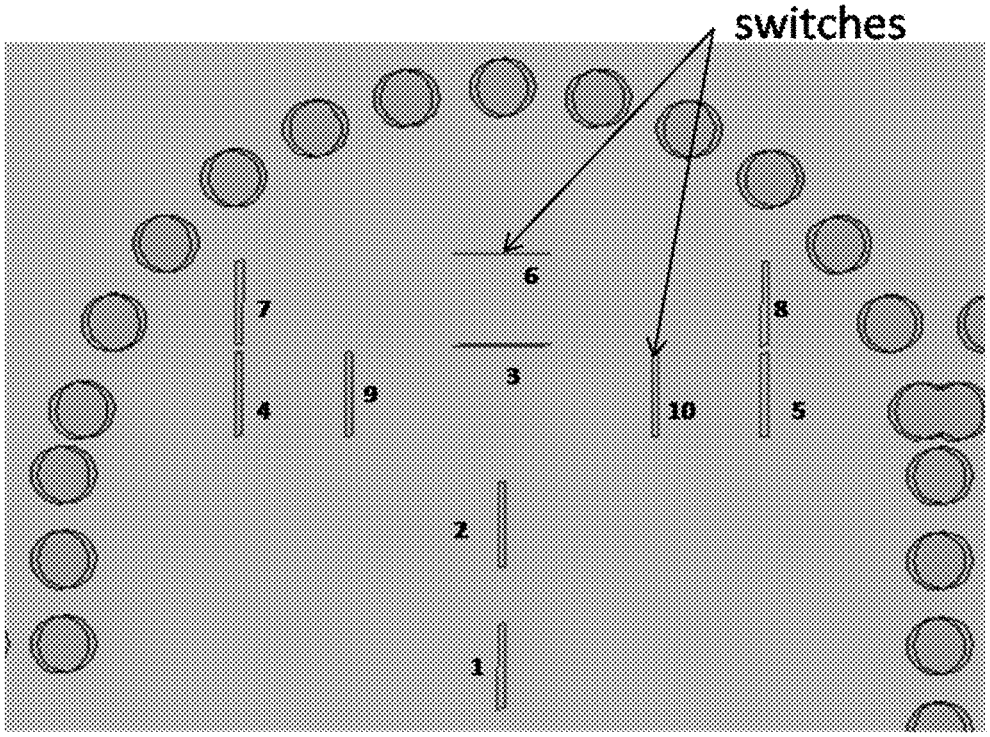
FIG. 6 is a view of one curved section of the SIW including switches, wherein the switches are designed to provide the different phase shifters.

Another alternative phase shifter design is shown in FIG. 6 and is based on the use of switching diodes. The switching diodes could be PIN diodes, which are basically comprised of a p-type semiconductor region separated from an n-type semiconductor region by a wide, undoped intrinsic semiconductor. An advantage of the PIN is the switching time. Using the PIN, the switching time becomes very fast comparing to the liquid metal switching mechanism. The switching diodes are turned on or off, to effectively change the electrical length of the wave path, and thus to change the phase. In either embodiment, to realize one phase shifter we there needs to be a number of vias or diodes not just one via or one diode for each phase shifter. In the second technique (see FIG. 6), which approach is faster than the liquid metal approach, phase shifting is based on the use of multiple PIN diode switches (e.g., switches 1, 2, 3, 4, 5, 6, 7, 8, 9 and 10, as shown in FIG. 6) that are either on or off depending upon their bias levels. This is, similar to the FIG. 5 embodiment, achieved by positioning or depositing the switches inside the curved sections, just as for the case of liquid metal vias. The advantage of the PIN is the switching time: using the PIN, the switching time becomes very fast comparing to the liquid metal switching mechanism.

The proposed general design shown in FIG. 2, with variations shown in FIGS. 5 and 6 effectively varies the electrical length between the adjacent radiating elements, and it does this by using switchable vias inside the waveguide which connects the two adjacent radiating elements. FIG. 4 highlights the curved SIW without any phase shifter, while FIG. 2 highlights an example of one phase shifter presented by 6 vias inserted in the curved sections. Variable phase shifts are realized by placing and arranging the vias in various locations to alter the effective width of the guide and thereby control the wave propagation in the guide. Low loss is achieved by using high quality PIN diodes that are still low cost (see FIG. 6). This type of phase shifter provides a stepwise phase shift, e.g. 30 deg. 60 deg., 90 deg., etc. Though not shown here, a separate and auxiliary phase shifting mechanism can be added to the stepwise phase shifters, if desired.

The proposed design utilizes physics which is totally different from the design that forms the basis of legacy phase shifting devices, e.g., ferrite phase shifters. A desired phase shift can be achieved by varying the configuration of the vias inserted in the curved sections of the waveguide. As noted above to have mutually exclusive combinations of being filled with a liquid metal or being devoid of filling by a liquid metal. Varying the configuration of the vias, in turn, changes the propagation constant within the guide and thus achieves different electrical lengths of the curved sections of the SIW guide, even though their physical lengths remain unchanged. The via patterns inside the curved web guide sections are reconfigured to realize different phase. It is possible after configuring the control mechanism of the wave propagation in the guide to have mutually exclusive combinations of being filled with a liquid metal or being devoid of filling by a liquid metal.

Figure 7:
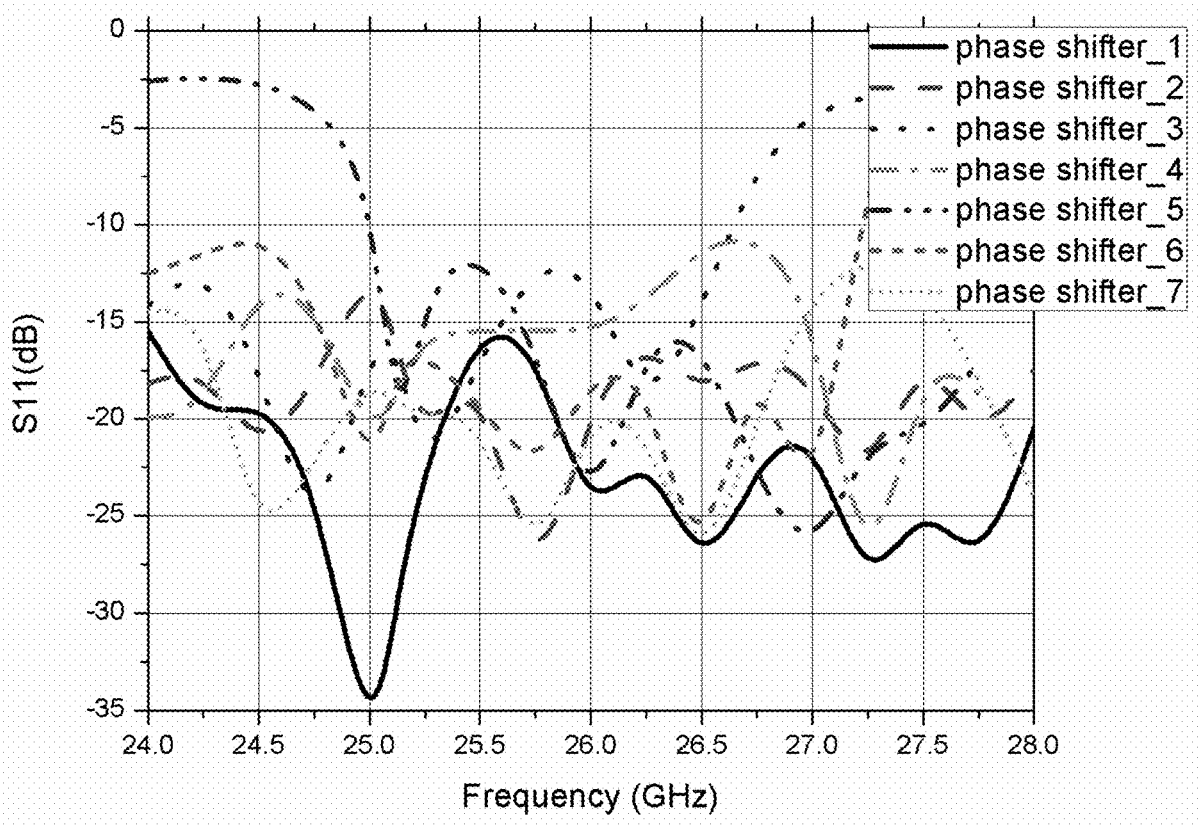
FIG. 7 is a graph showing a simulated reflection coefficient.

In some embodiments, as shown in FIG. 7, seven different phase shifters (phase shifter 1, 2, 3, 4, 5, 6, and 7) are used. The simulated reflection coefficients for all the seven phase shifters are plotted in FIG. 7, for the frequency range (i.e., "Frequency (GHz)" shown in FIG. 7) as of 25 GHz to 26.7 GHz. The return loss ($S_{11}$) for all the phase shifters is seen to be better than −10 dB in the frequency range of interest mentioned above. The proposed phase shifter introduced in the curved SIW can provide phase shifts in the range of 0 to 360°.

Figure 8:
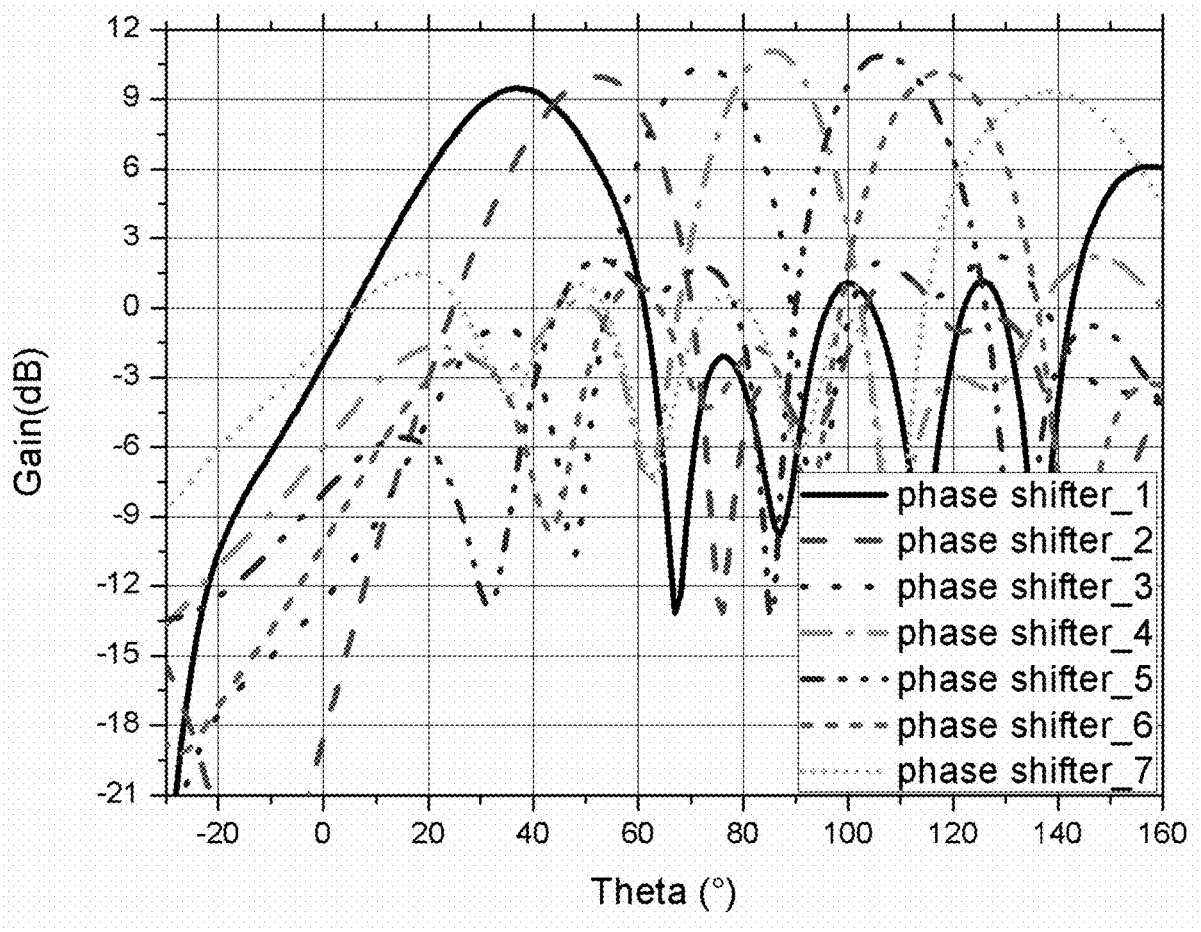
FIG. 8 is a graph showing a simulated gain showing the scan capability.

FIG. 8 shows the simulated the gain plots in dB at 26 GHz for different scan angles (i.e., Theta in °), and we observe that the gain varies only moderately, between 9.5 dB and 11 dB as different phase shifters are actuated, which is highly desirable for a scanning array. To have the seven different lobe directions as presented in FIG. 8, we need seven different phase shifters (phase shifter 1, 2, 3, 4, 5, 6, and 7). The switching from a phase shifter to another is being performed by filling of some vias with a liquid metal or by activating some diodes for the PIN diodes case. Furthermore, when we activate one phase shifter at a time, the return loss (S11) is seen to be better than −10 dB in the frequency range 25 to 26.7 GHz and the gain varies only moderately, between 9.5 dB and 11 dB.

The novel proposed microwave scanning array system offers "low-cost" platforms that can be ground-based or mounted on mobile platforms, e.g., airplanes, ships and buses for SATCOM systems. The main beneficiary of the proposed scanning array system will be broadband mobile communication industry because the proposed "low-cost" platforms can be ground-based or mounted on mobile platforms, e.g., airplanes, ships and buses for SATCOM systems offering broadband, wide connectivity, high capacity, high speed data transfer, without using conventional ferrite type phase shifters that can be prohibitively costly as well as lossy. The phase shifting system can be fabricated relatively easily using existing electronic components and it is both low loss and relatively low cost.

The invention claimed is:

1. A substrate integrated waveguide (SIW) for millimeter wave applications, comprising:

a substrate having length, width, and height dimensions;

a wave entry port on a first end of the substrate and a wave exit port on a second end of the substrate, wherein the first and second ends are opposite ends of the substrate;

a waveguide comprising a plurality of curved sections and which passes through the substrate from the wave entry port to the wave exit port, wherein the plurality of curved sections forms a serpentine path of curves in a first direction followed by curves in a second direction which is opposite the first direction, a plurality of radiating members which extend into the waveguide between curves in the first direction and curves in the second direction; and phase shifting elements in the waveguide in each of the curved sections, wherein the phase shifting elements are comprised of a plurality of spaced apart vias which extend into the waveguide.

2. The SIW of claim 1 wherein at least some of the plurality of spaced apart vias are filled with the liquid metal.

3. The SIW of claim 1 wherein at least some of the plurality of spaced apart vias are empty holes in a dielectric.

4. The SIW of claim 1 wherein the radiating members are each semicircular.

* * * * *